US005125227A

United States Patent [19]

Ford et al.

[11] Patent Number: 5,125,227

[45] Date of Patent: Jun. 30, 1992

[54] MOVABLE COMBUSTION SYSTEM FOR A GAS TURBINE

[75] Inventors: John E. Ford, Schenectady; Albert Myers, Amsterdam, both of N.Y.

[73] Assignee: General Electric Company, Schenectady, N.Y.

[21] Appl. No.: 550,510

[22] Filed: Jul. 10, 1990

[51] Int. Cl.[5] ..... F02C 9/00

[52] U.S. Cl. ..... 60/39.230; 60/740

[58] Field of Search ..... 60/39.141, 39.23, 39.27, 60/39.29, 39.33, 733, 740, 746

[56] References Cited

U.S. PATENT DOCUMENTS 2,655,787 10/1953 Brown ..... 60/39.27
4,150,539 4/1979 Rubins et al. ..... 60/39.23
4,292,801 10/1981 Wilkes et al. ..... 60/733
4,982,570 1/1991 Waslo et al. ..... 60/733

*Primary Examiner*—Richard A. Bertsch
*Assistant Examiner*—Timothy S. Thorpe
*Attorney, Agent, or Firm*—Nixon & Vanderhye

[57] ABSTRACT

The movable combustion system includes an outer liner defining a venturi and a centerbody including an inner liner terminating in swirler blades defining a gap at the rearmost end of the centerbody with the venturi. A secondary fuel nozzle lies within the centerbody. The centerbody is mounted to the combustor cover for axial translational non-rotational movement from a location outside the cover and during gas turbine operation to axially displace the secondary fuel nozzle and alter the gap between the centerbody and the venturi.

9 Claims, 2 Drawing Sheets

MOVABLE COMBUSTION SYSTEM FOR A GAS TURBINE

BACKGROUND AND SUMMARY OF THE INVENTION

The present invention relates to a combustor for a gas turbine combustion system and particularly relates to apparatus and methods for displacing a fuel nozzle and altering the gap in a venturi section of a gas turbine combustor during operation to vary performance and stability in the combustor and reduce $NO_x$ emissions.

One of the principal objectives in modern-day gas turbine manufacturing and gas turbine operation is to minimize emissions from nitrogen oxides ($NO_x$) Many different concepts have been proposed and used for reducing such emissions, for example, by reducing flame temperature, residence time of the gases at peak temperatures, or by introducing water or steam into the flame. However, practical considerations preclude use of many of these proposals. For example, complexity of structure, higher operating costs and degradation of other performance parameters frequently occur when such proposals are adopted.

It has previously been found that a venturi configuration can be used to stabilize combustion flame. In such arrangements, reduced $NO_x$ emissions are achieved by lowering peak flame temperatures by burning a lean, uniform mixture of fuel and air. In the pre-mixed mode, fuel is supplied to both the primary and secondary nozzles (predominantly in the primary nozzle) and mixes in a pre-mixing chamber upstream of the venturi. The pre-mixed gases then pass through the venturi gap before igniting and combustion occurs downstream of the venturi gap.

It has been found that the venturi gap has an effect on the emissions in the pre-mixed mode. More particularly, it has been found that a smaller gap, when operating in the pre-mixed mode, provides reduced emissions. Recognizing this, however, means also to have recognized that the fuel nozzles, liners and various ancillary parts are conventionally rigidly secured within the combustor, with no purposeful or intended relative movement between such parts. Typically, relative movement of such parts is only incidental to operation of the combustor, i.e., a result only of thermal expansion. It has thus been found desirable to not only change the gap during operation in the pre-mixed mode but also to move the secondary fuel nozzle relative to the combustor end plate and the gap.

Therefore, in accordance with the present invention, there is provided a movable combustion system in the combustor of a gas turbine wherein the centerbody of the combustor upstream of the venturi is axially displaceable to alter the extent of the gap between the venturi and the centerbody, as well as axially displace the secondary fuel nozzle, all displacements being performed purposefully and intentionally during operation of the gas turbine. To accomplish this, the centerbody of the combustor is carried on an axially displaceable support element or pipe, which also carries the secondary fuel nozzle and supplies fuel thereto. The pipe is connected at its end passing through the combustor cover to an externally threaded centerbody support element, preferably a sleeve, for cooperation with a threaded member secured to and accessible from outside of the cover. The support element is keyed to the cover to prevent rotation of the centerbody during axial displacement thereof. Consequently, by rotating the internally threaded member outside of the cover, the centerbody support element carrying the secondary fuel nozzles, as well as ancillary structure including the inner liner, swirler blades and other structure, are axially displaced relative to the cover, venturi and primary fuel nozzle. Thus, the downstream end of the centerbody is adjusted axially relative to the venturi whereby the gap between the venturi and the centerbody end as well as the location of the secondary fuel nozzles may be adjusted during operation.

In a preferred embodiment according to the present invention, there is provided a combustor assembly for a gas turbine comprising a combustor body having an outer liner, a centerbody carrying an inner liner and a cover, and arranged about an axis, means carried by the assembly for supplying fuel within the combustor body, means for supplying air within the combustor body, means defining a venturi and means including a portion of the centerbody defining a gap with the venturi. Means are also provided external to the combustor body and connected to the centerbody for moving the centerbody in an axial direction for changing the size of the venturi gap.

In a further preferred embodiment according to the present invention, there is provided a combustion assembly for a gas turbine comprising a combustion body having an outer liner, a centerbody carrying an inner liner and a cover, means for supplying fuel within the combustor body including a fuel nozzle and means external to the combustor body and connected to the fuel nozzle for moving the fuel nozzle in an axial direction for changing the axial location of the fuel nozzle relative to the combustor body.

In a further preferred embodiment according to the present invention, there is provided a method of operating a combustor for a gas turbine wherein the combustor has a fuel/air pre-mixing chamber, a combustor chamber downstream from the pre-mixing chamber and a venturi, comprising the steps of flowing the fuel/air mixture into the combustion chamber through a gap formed by a fixed surface of the venturi and a movable surface and altering the size of the gap by displacing the movable surface relative to the fixed surface.

In a further preferred embodiment according to the present invention, there is provided a method of operating a combustor for a gas turbine wherein the combustor has a fixed primary fuel nozzle adjacent a forward end of the combustor and a movable secondary fuel nozzle axially downstream from the primary fuel nozzle comprising the step of axially displacing the secondary fuel nozzle relative to the primary fuel nozzle during operation of said gas turbine.

Accordingly, it is a primary object of the present invention to provide novel and improved apparatus and methods for displacing the centerbody of a combustor thereby to displace the secondary fuel nozzle relative to the cover and alter the gap in the venturi as desired in a dry, low $NO_x$ turbine and during operation.

These and further objects and advantages of the present invention will become more apparent upon reference to the following specification, appended claims and drawings.

BRIEF DESCRIPTION OF THE DRAWING FIGURES

FIG. 1 is a fragmentary cross-sectional view of a portion of a combustor for a gas turbine illustrating only about one-half of the combustor and with the centerbody of the combustor in its forwardmost position; and FIG. 2 is a view similar to FIG. 1 illustrating the centerbody of the combustor in its rearmost position after full axial movement.

DETAILED DESCRIPTION OF THE DRAWING FIGURES

Figure 1:
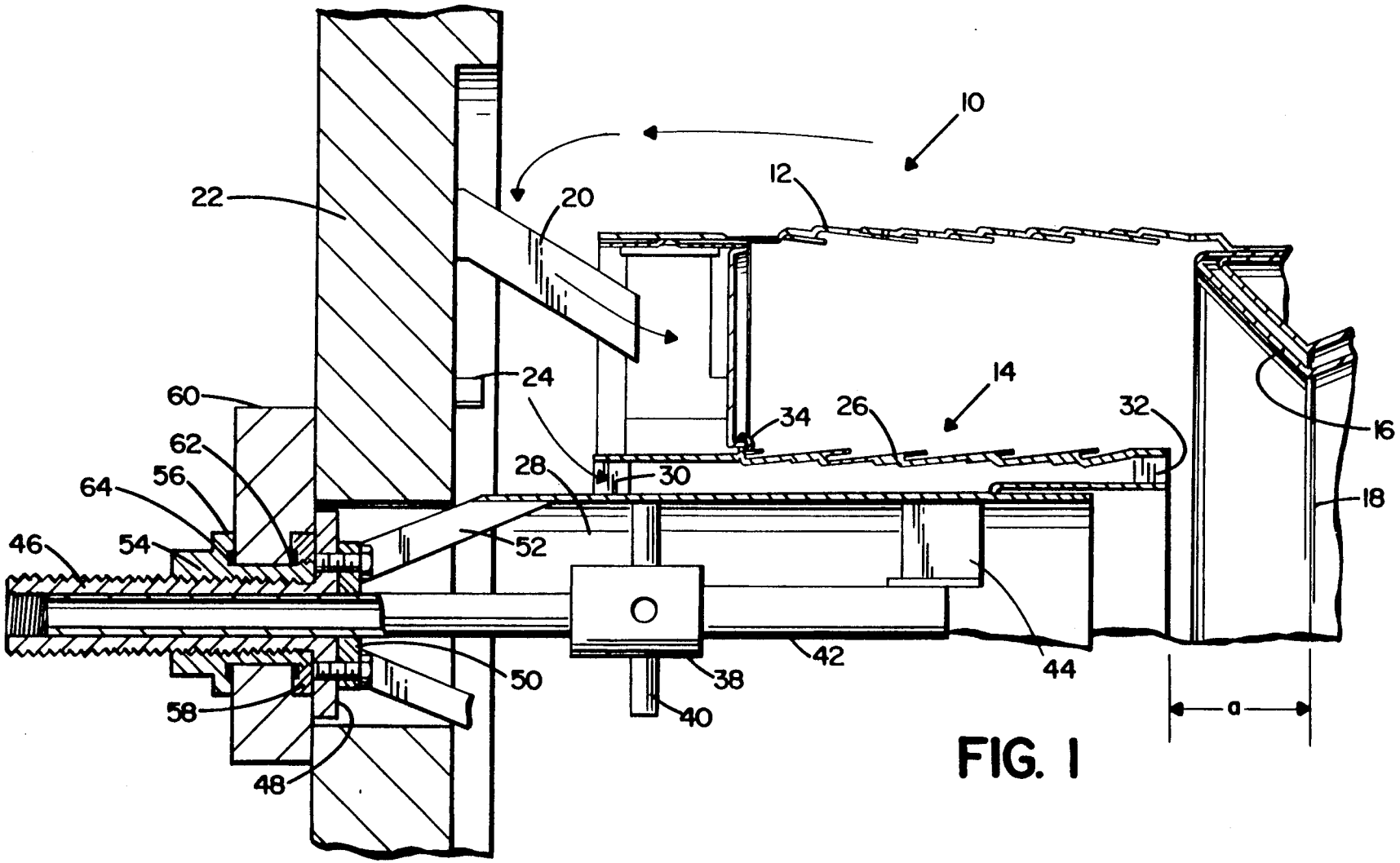

Reference will now be made in detail to the present preferred embodiment of the invention, an example of which is illustrated in the accompanying drawings.

Referring now to the drawing figures, there is illustrated a portion of one of a series of annular combustors for a gas turbine engine and in which only the upper half of a single combustor, generally designated 10, is illustrated, the lower half being the mirror image of the upper half. Thus, a plurality of combustion and pre-mix chambers are circumferentially arranged inside the combustor 10. Combustor 10 includes an outer liner 12 and a centerbody, generally designated 14. The outer liner 12 is connected at its rear end to a conical wall 16 forming a venturi or reduced diameter portion 18. The forward end of liner 12, including various ancillary structure, not shown, conventionally found in a combustor, is connected by suitable support struts 20 to a combustor end plate or cover 22. The cover carries a plurality of primary fuel nozzles 24 for disposing fuel in the chamber between outer liner 12 and centerbody 14. It will be appreciated that air flow into the combustor is accomplished in a conventional manner, e.g., by flow from right to left along the outside of line 12 in FIG. 1 and flow from left to right within liners 12 and 26 and flow from left to right within sleeve 28 and about pipe 42 in FIG. 1 as indicated by the arrows.

In accordance with the present invention, centerbody 14 is axially displaceable relative to cover 22, outer liner 12 and the ancillary support structure, by a centerbody support structure, described hereinafter. It will be appreciated with reference to FIG. 1 that centerbody 14 includes an inner liner 26, a central sleeve or support structure 28, which is suitably apertured to enable air to pass through sleeve 28, a plurality of vanes 30 which interconnect inner liner 26 and sleeve 28 at a forward location thereof, and swirler blades 32 which interconnect inner liner 26 and the downstream end of sleeve 28 adjacent to venturi 18. A spring seal 34 is disposed between centerbody 14, particularly its inner liner 26, and the stationary elements of the outer liner 10. The centerbody 14 also includes a secondary fuel nozzle 38 having a series of fuel spokes 40 for distributing fuel in a secondary region and to the pilot nozzle. Secondary nozzle 38 is mounted on a support member or pipe 42, which fuel is supplied to secondary fuel nozzle 38 and the pilot nozzle. Pipe 42 is supported by the sleeve 28 at its downstream end by a plurality of circumferentially spaced swirler blades 44. The forward end of pipe 42 is secured within an externally threaded support element 46. Element 46 terminates at its inner end in an enlarged flange 48 having suitable threaded bolt openings. A support ring 50 is bolted on the inside of flange 48 and a plurality of struts 52 project radially outwardly and axially rearwardly from flange 48 for connection with sleeve 28. Consequently, it will be appreciated that, upon axial displacement of support element 46, both centerbody 14 and secondary nozzle 38, move axially with support element 46. Element 46 is keyed to cover 22 by means, not shown, whereby element 46 is axially translatable but not rotatable.

To translate support element 46 in the axial direction, there is provided an internally threaded rotatable outer sleeve or nut 54 which threadedly engages the externally threaded support element 46. Outer sleeve 54 has an integral flange 56 at its outside end. An annular element 58 is secured on the inner end of sleeve 54 on the opposite side from flange 56 of an endplate 60. Endplate 60 is secured to cover 22 against rotation, by means not shown. A gasket 62 is provided between annular element 58 and endplate 60 while a similar gasket 64 is provided between flange 56 and endplate 60. It will be appreciated that, upon rotation of outer sleeve 54, for example, by application of a wrench thereto, support element 46 will thread inwardly or outwardly and, hence, axially translate in opposite directions. Consequently, centerbody 14 may be axially translated between the extreme positions illustrated in FIGS. 1 and 2 and maintained in any axially adjusted position therebetween.

Figure 2:
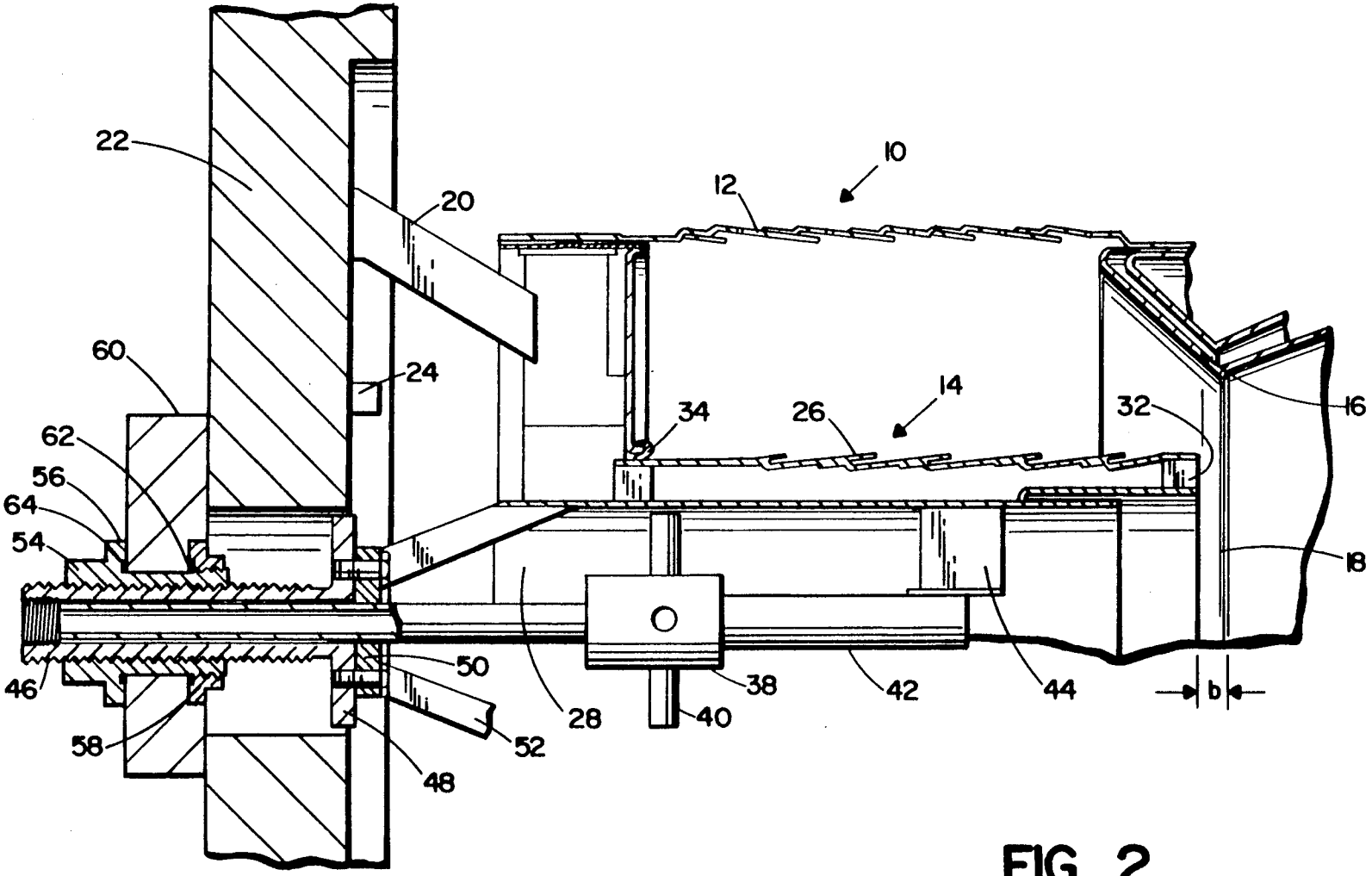

It will be appreciated from a comparison of FIGS. 1 and 2 that by threading outer support sleeve 54 to translate centerbody 14 forwardly toward cover 22 and into its forwardmost position as illustrated in FIG. 1, the gap "a" between the trailing end of centerbody 14 and venturi 18 opens to its maximum extent. Additionally, the secondary fuel nozzle 38 carried by pipe 42 is positioned in its forwardmost position as illustrated in FIG. 1. When it is desired to alter the gap between the venturi and the centerbody and to relocate the secondary nozzle, an operator may apply a wrench to sleeve 54. By rotating sleeve 54, the threading action translates support element 46, and hence centerbody 14, in an axial rearward direction into an adjusted position. As illustrated in FIG. 2, the trailing end of centerbody 14 may close to a minimum gap "b" with venturi 18 upon translating centerbody 14 into its rearmost axial position. Similarly, fuel nozzle 38 is simultaneously advanced with centerbody 14 into its rearwardmost position. It will be appreciated that the position of the secondary fuel nozzle and the size of the gap are changed simultaneously with the foregoing arrangement. Consequently, when the turbine is operating in the pre-mixed mode, the gap between the trailing end of the centerbody and the venturi can be altered to selected axially adjusted positions to tune the combustion to minimize emissions during operation of the turbine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor assembly for a gas turbine comprising:

a combustor having an outer liner disposed about an axis and a dover adjacent one end of said outer liner, a centerbody carried by said cover and carrying an inner liner about said axis and inside of and radially spaced from said outer liner;

means carried by said assembly for supplying fuel within the combustor;

means for supplying air within the combustor;

means forming a venturi adjacent an opposite end of said outer liner, and including a portion of said centerbody defining a gap forming part of said venturi; and means external to said combustor and connected to said centerbody for moving said centerbody in an axial direction for adjusting the size of said venturi gap.

2. An assembly according to claim 1 wherein said moving means includes a carrier sleeve extending through said cover and carrying said centerbody.

3. An assembly according to claim 1 wherein said gap defining centerbody portion includes an end portion of said inner liner.

4. An assembly according to claim 3 wherein said moving means includes a carrier sleeve extending through said cover and carrying said centerbody.

5. An assembly according to claim 4 including means for moving said carrier sleeve in an axial direction.

6. An assembly according to claim 5 wherein said carrier sleeve is externally threaded, said moving means including a rotatable nut carried by said cover and fixed against axial movement, said nut lying in threaded engagement with said carrier sleeve for axially displacing the latter in response to rotation of said nut.

7. An assembly according to claim 1 including a primary fuel nozzle carried by said combustor, and a secondary fuel nozzle carried by said moving means for axial movement therewith.

8. An assembly according to claim 7 wherein said moving means includes a support element extending through said cover and carrying said secondary fuel nozzle, and means for axially moving said support element to move said secondary fuel nozzle with said centerbody.

9. An assembly according to claim 8 wherein said support element comprises a pipe for carrying fuel to said secondary fuel nozzle; and means connecting said carrier sleeve and said pipe for joint movement whereby said secondary fuel nozzle and said inner liner are jointly movable.

* * * * *